US005120041A

United States Patent [19]

Schniter

[11] Patent Number: 5,120,041

[45] Date of Patent: Jun. 9, 1992

[54] SELECTIVE SUCKER ARM LIFTOFF

[75] Inventor: Jorg Schniter, Glenview, Ill.

[73] Assignee: R. R. Donnelley & Sons Company, Chicago, Ill.

[21] Appl. No.: 669,535

[22] Filed: Mar. 14, 1991

[51] Int. Cl.[5] ..... B65H 3/08

[52] U.S. Cl. ..... 271/107; 271/100; 271/106; 271/256; 271/275

[58] Field of Search ..... 271/11, 14, 96, 100, 271/106, 107, 275, 276, 256, 257, 258

[56] References Cited

U.S. PATENT DOCUMENTS

| | | | |
|---|---|---|---|
| 3,007,697 | 11/1961 | Mosemiller | 271/257 |
| 3,419,263 | 12/1968 | Weidman . | |
| 3,608,893 | 9/1971 | McCain et al. | 271/256 |
| 3,674,255 | 7/1972 | Arnell . | |
| 3,828,673 | 8/1974 | Gazzola et al. | 271/257 X |
| 3,834,691 | 9/1974 | Paulson | 271/100 |
| 3,934,868 | 1/1976 | Selak | 271/100 X |
| 4,353,393 | 10/1982 | Schniter . | |
| 4,456,241 | 6/1984 | Newsome | 271/100 X |
| 4,505,470 | 3/1985 | Reinert et al. . | |
| 4,524,691 | 6/1985 | Miller | 271/107 X |
| 4,592,542 | 6/1986 | Selak . | |
| 4,986,522 | 1/1991 | Paulson | 271/107 X |
| 5,014,979 | 5/1991 | Higgins et al. | 271/107 X |

FOREIGN PATENT DOCUMENTS

| | | | |
|---|---|---|---|
| 698347 | 10/1953 | United Kingdom | 271/107 |

*Primary Examiner*—H. Grant Skaggs

*Assistant Examiner*—Boris Milef

*Attorney, Agent, or Firm*—Wood, Phillips, VanSanten, Hoffman & Ertel

[57] ABSTRACT

In order to avoid striking and compacting signatures in a signature stack during a period of selective operational disablement of a gathering machine on a binding line, a system for selectively disabling and enabling operation of a sucker arm is provided. The system includes a cam operatively associated with a main drum for driven movement therewith and a cam follower arm operatively associated with the cam for driven movement thereby. The cam follower arm is interconnected to the sucker arm for imparting reciprocating movement to the sucker arm. The reciprocating movement normally traverses a path from the signature stack to the main drum and back again to feed signatures from the signature stack to the main drum for delivery to the binding line when the system enables operation of the sucker arm. The cam follower arm is interconnected to the sucker arm through a pushrod which extends to a crank mounted on a pivotal sucker tube for pivotal movement thereabout. The system is such that the sucker arm is mounted on the sucker tube whereby pivotal movement of the crank imparts reciprocating movement to the sucker arm. In order to accomplish the objectives of the invention, a mechanism is provided for varying the length of the pushrod on demand between a normal length and an extended length to alter the path of reciprocating movement to disable the sucker arm from its normally intended function.

9 Claims, 2 Drawing Sheets

SELECTIVE SUCKER ARM LIFTOFF

FIELD OF THE INVENTION

The present invention is generally directed to improvements in a gathering machine on a binding line and, more particularly, a system for selectively disabling and enabling operation of a sucker arm on a gathering machine.

BACKGROUND OF THE INVENTION

As will be appreciated, there are various mechanisms in which a member must be actuated at regular intervals but must be capable of being disabled and then later again enabled to selectively eliminate regular actuation of the member when desired. One such mechanism is a gathering machine for printed signatures in which a signature gripper is normally actuated at regular intervals to feed signatures seriatim to a travelling signature gathering belt or saddle on a binding line. In this connection, the increasing popularity of demographic editions of periodicals as well as the need to publish catalogs which contain many pages applicable to all parts of the country and other pages applicable only to certain regions is now well recognized.

Because of this demand, it has become necessary to develop gathering machines in which certain signature grippers or sucker arms are selectively disabled and enabled in order that the binding line may receive signatures fed by those signature grippers or sucker arms only when desired As suggested hereinabove, a signature gripper commonly comprises a sucker arm which is oscillated to contact a signature while under vacuum and then to swing away thereby pulling the signature which is later freed by release of the vacuum when it reaches the main drum of the gathering machine. Both the mechanical oscillation of the signature gripper or sucker arm and the regular actuation and release of the suction are accomplished by mechanisms which are a part of the overall drive system to thereby eliminate any timing problems In this connection, the valve which controls the vacuum ordinarily is moved between an open position which places the grippers under vacuum and a closed position which eliminates the vacuum at the grippers by appropriate means such as rotation of a cam shaft which is operated by the drive system.

In order to take advantage of this fact, I have already developed a simple but highly effective apparatus which is capable of selectively eliminating the regular connection of the signature grippers or sucker arm to a source of suction or vacuum. This system is fully disclosed and claimed in commonly owned U.S. Pat. No. 4,353,393 which issued on Oct. 12, 1982, and it is specifically directed to a selective shut-off for repetitively operated valves so that even though the signature grippers or sucker arm continue to oscillate, they are temporarily unable to feed signatures. While this has proven to be most effective for the intended purpose, I have discovered that the continual striking of the sucker cups of the signature grippers or sucker arm onto the signatures during a long shut-off period can have a tendency to compact the signature stack.

As a result, it has remained to provide a system for selectively disabling the operation of the sucker arm so that the sucker cups cannot strike the signature stack when disabled.

SUMMARY OF THE INVENTION

It is therefore a principal object of the present invention to provide a system for selectively disabling and enabling operation of a sucker arm. It is a further object of the present invention o provide such a system wherein the sucker arm is caused to traverse an altered path wherein it cannot feed signatures from or even contact a signature stack for so long as the sucker arm remains selectively disabled. It is yet another object of the present invention to provide a simple, inexpensive, and effective means for controlling the operation of the sucker arm.

In an exemplary embodiment of a gathering machine on a binding line, a system for selectively disabling and enabling operation of a sucker arm includes cam means operatively associated with a main drum for driven movement therewith and cam follower arm means operatively associated with the cam means for driven movement thereby. The system further includes means for interconnecting the cam follower arm means to the sucker arm for imparting reciprocating movement to the sucker arm. The reciprocating movement normally traverses a path from a signature stack to the main drum and back again to feed signatures from the signature stack to the main drum for delivery to the binding line when the system is set to enable operation of the sucker arm. The system is such that the interconnecting means includes means for altering the path of reciprocating movement on demand so as to be capable of disabling the sucker arm. With this arrangement, the path altering means causes the sucker arm to traverse an altered path wherein it cannot feed signatures from the signature stack to the main drum until such time as the path altering means returns it to the normal path of reciprocating movement from the signature stack to the main drum.

In a most highly preferred embodiment, the interconnecting means includes a sucker tube mounted on a pivotal sucker tube for pivotal movement thereabout. The sucker arm is then mounted on the sucker tube such that pivotal movement of the crank serves to impart reciprocating movement to the sucker arm. Further, the interconnecting means includes a pushrod extending from the cam follower arm means to the crank for imparting pivotal movement to the crank.

With this arrangement, the cam follower arm means serves to impart linear reciprocating movement to the pushrod in response to driven movement by the cam means. The linear reciprocating movement of the pushrod, in turn, serves to impart a predetermined range of reciprocating pivotal movement to the crank. In this manner, the reciprocating pivotal movement of the crank enables the sucker arm to feed signatures from the signature stack to the main drum.

Preferably, the cam follower arm means includes a pair of drive arms having first ends mounted on a pivotal shaft for pivotal movement thereabout. The drive arms are advantageously disposed at a fixed angle to one another such that the first ends thereof define the apex of the angle. Further, the drive arms each have a second end with one being operatively associated with the cam means and the other being operatively associated with the pushrod.

In a most highly preferred embodiment, the length of the pushrod may be varied by a cylinder and piston comprising a portion thereof. The piston is advantageously retractable and extendable on demand to thereby vary the length of the pushrod to thereby shift the location where the sucker arm is reciprocated. As a result, the pushrod is selectively extendable to a disabled position and selectively retractable to an enabled position for the sucker arm.

Other objects, advantages and features of the present invention will become apparent from a consideration of the following specification taken in conjunction with the accompanying drawings.

DETAILED DESCRIPTION OF THE PREFERRED EMBODIMENT

Figure 1:
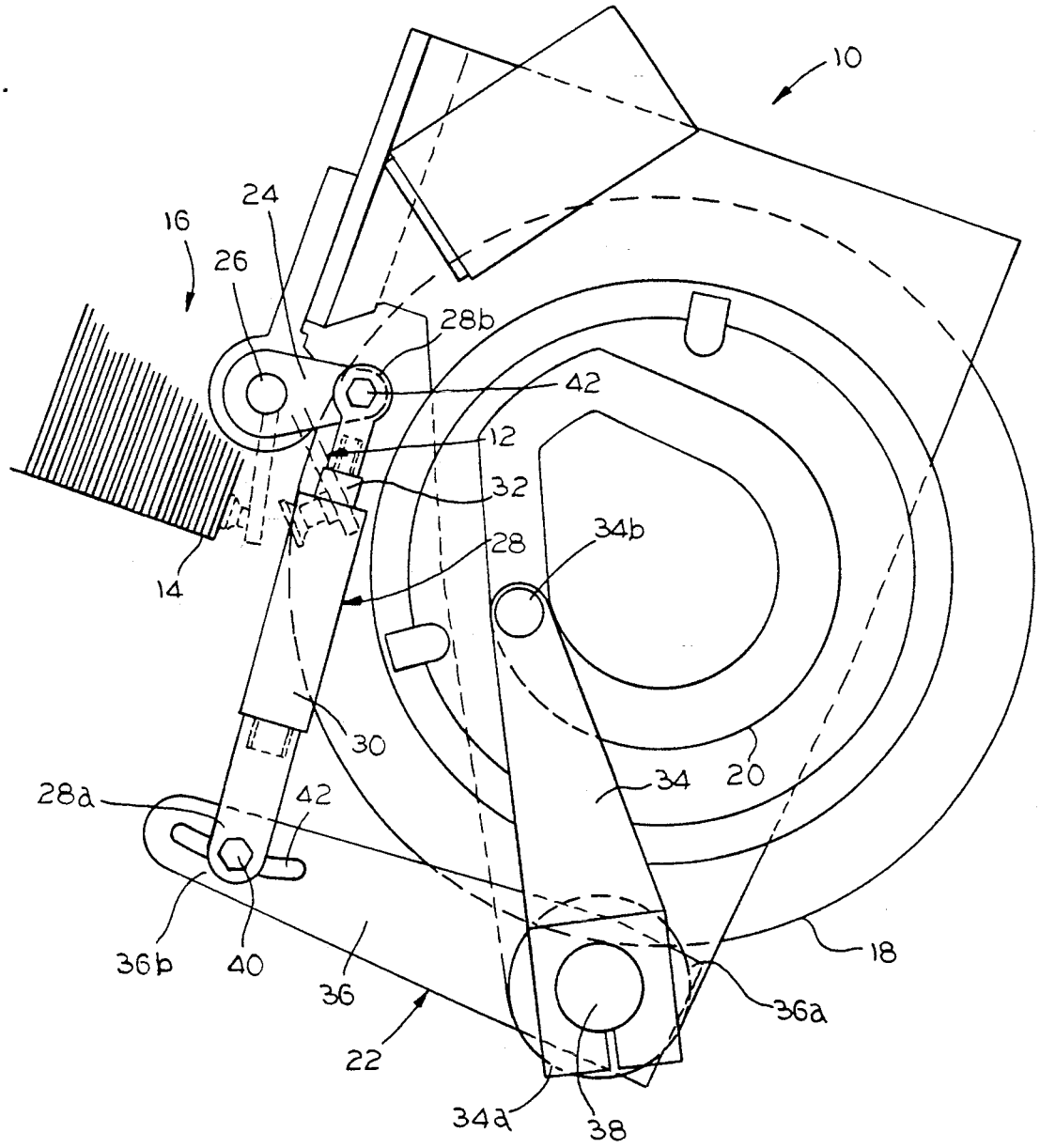
FIG. 1 is a partially schematic side elevational view of a gathering machine having a system for selectively disabling and enabling operation of a sucker arm showing the limits of motion of the sucker arm in a selectively enabled condition.
Figure 2:
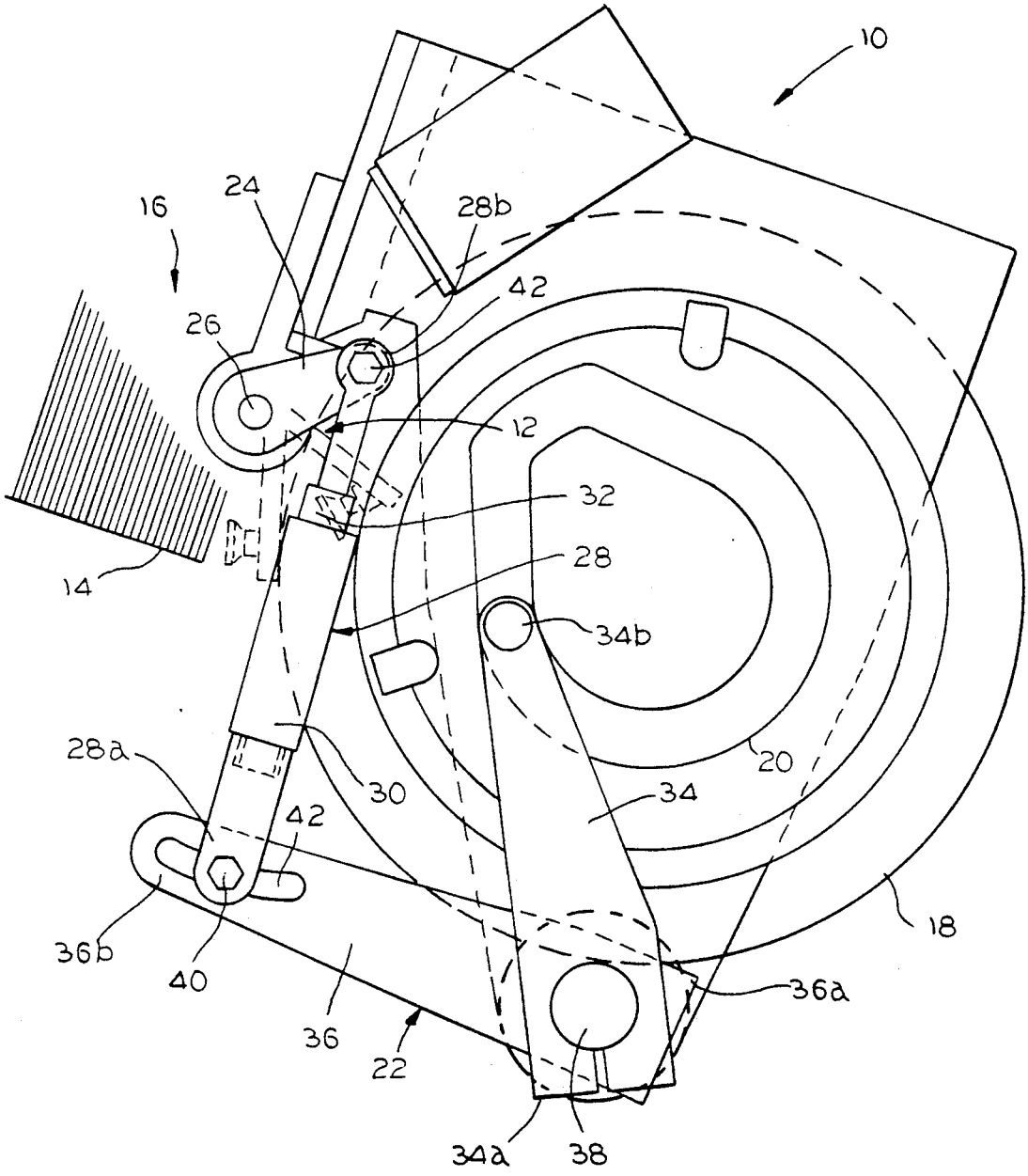
FIG. 2 is a partially schematic side elevational view of a gathering machine having a system for selectively disabling and enabling operation of a sucker arm showing the limits of motion of the sucker arm in a selectively disabled condition.

In the illustrations given, and with reference to both of FIGS. 1 and 2, the reference numeral 10 designates generally a gathering machine on a binding line having a sucker arm 12 for feeding signatures 14 from a signature stack 16 to a main drum 18. These components, per se, are basically conventional and, thus, the details thereof will be omitted except to the extent that such details are necessary to achieve a full and proper understanding of the present invention. As a result, it will be appreciated that the discussion which follows will be primarily directed to details of the unique system for selectively disabling and enabling operation of the sucker arm 12 in accordance with the present invention.

As shown, the system includes cam means 20 operatively associated with the main drum 18 for driven movement therewith and cam follower arm means 22 operatively associated with the cam means 20 for driven movement thereby. It will also be seen that the system includes means such as the crank 24 and pushrod 28 for interconnecting the cam follower arm means 22 to the sucker arm 12 for imparting reciprocating movement to the sucker arm 12 wherein the reciprocating movement is such as to normally traverse a path from the signature stack 16 to the main drum 18 and back again (see FIG. 1) so as to feed signatures 14 from the signature stack 16 to the main drum 18 for delivery to the binding line when the system is selectively set to enable operation of the sucker arm 12. Still further, the system also includes means for altering the path of reciprocating movement of the sucker arm 12 on demand so as to disable the sucker arm 12 as will be described in detail hereinafter (compare FIGS. 1 and 2).

As will be seen, the crank 24 is mounted on a pivotal sucker tube 26 for pivotal movement thereabout and the sucker arm 12 is mounted on the sucker tube 26 such that pivotal movement of the crank 24 imparts reciprocating movement to the sucker arm 12. The pushrod 28 then extends from the cam follower arm means 22 to the crank 24 for imparting pivotal movement to the sucker tube 26 and, in particular, the pushrod 28 imparts the same predetermined range of reciprocating movement no matter whether the sucker arm 12 is traversing its normal path of movement or its altered path of movement (compare FIGS. 1 and 2). In this connection, the path altering means may advantageously include means for varying the length of the pushrod 28 on demand between a normal operating length and an extended operating length (again, compare FIGS. 1 and 2).

With this arrangement, the cam follower arm means 22 can be seen as capable of imparting linear reciprocating movement to the pushrod 28 in response to driven movement by the cam means 20. The linear reciprocating movement of the pushrod 28, in turn, imparts a predetermined range of reciprocating pivotal movement to the crank 24 and, thus, to the sucker tube 26 and the sucker arm 12. As a result, the reciprocating pivotal movement of the crank 24 normally enables the sucker arm 12 to feed signatures 14 from the signature stack 16 to the main drum 18 for delivery to the binding line.

During operation, and on demand, the path altering means can be selectively activated to cause the sucker arm 12 to thereafter traverse an altered path of reciprocating movement to disable operation of the sucker arm 12. When this occurs, the sucker arm 12 is disabled so as to no longer feed signatures from the signature stack 16 to the main drum 18 until such time as the path altering means is once again selectively activated. In other words, and again on demand, the path altering means can again be selectively activated to return the sucker arm 12 to its normal path of reciprocating movement to again enable operation of the sucker arm 12.

For this purpose, the means for varying the length of the pushrod 28 preferably includes a cylinder 30 and a piston 32 which together comprise at least a portion of the pushrod 28. The piston 32 is retractable and extendable on demand and can thereby vary the length of the pushrod 28 to thereby shift the location where the crank 24 and sucker tube 26, thus, the sucker arm 12 are reciprocated. As a result, the pushrod 28 is selectively extendable to a disabled position of operation for the sucker arm 12 and selectively retractable to an enabled position of operation for the sucker arm 12.

By referring to FIGS. 1 and 2, it will be seen and appreciated that the cam follower arm means 22 preferably includes a pair of drive arms 34 and 36 which are each mounted on a pivotal shaft 38 at a fixed angle to one another for pivotal movement thereabout. The apex of the fixed angle between the drive arms 34 and 36 is formed by the first ends **34*a* and 36*a* thereof. Also as shown, the drive arms 34 and 36 each have a second end 34*b* and 36*b* such that one of the ends 34*b* is operatively associated with the cam means 20 and the other of the ends 36*b* is operatively associated with one end 28*a* of the pushrod 28**.

In the preferred embodiment, the cylinder 30 comprises an air cylinder utilized as a portion of the pushrod 28. It will be seen that the end **28*a* of the pushrod 28 is secured to the end 36*b* of the drive arm 36 as at 40 wherein the actual point at which the two are secured may be varied by means of an arcuate slot 42 in the drive arm 36 that allows for stroke adjustment of the relative orientation of the various components that serve to drive the sucker arm 12. At the other end 28*b*, the pushrod 28 is secured to the crank 24 as at 44** by any conventional means.

As will now be appreciated, the present invention provides a very simple and inexpensive manner of selectively disabling and enabling operation of a sucker arm on a gathering machine such that signatures are not struck and compacted during operational disablement.

While in the foregoing there has been described a preferred embodiment of the invention, it will be appreciated that the details herein given may be varied by those skilled in the art without departing from the true spirit and scope of the appended claims.

I claim:

1. In a gathering machine on a binding line having a sucker arm for feeding signatures from a signature stack to a main drum, a system for selectively disabling and enabling operation of said sucker arm, said system comprising:

cam means operatively associated with said main drum for driven movement therewith;

cam follower arm means operatively associated with said cam means for driven movement thereby; and means for interconnecting said cam follower arm means to said sucker arm for imparting reciprocating movement to said sucker arm, said reciprocating movement normally traversing a path from said signature stack to said main drum and back again to feed signatures from said signature stack to said main drum for delivery to said binding line when said system enables operation of said sucker arm, said interconnecting means including means for altering said path of reciprocating movement on demand to disable said sucker arm;

said path altering means causing said sucker arm to traverse an altered path wherein said sucker arm cannot feed signatures from said signature stack to said main drum until such time as said path altering means returns said sucker arm to said path of reciprocating movement from said signature stack to said main drum on demand to again enable operation of said sucker arm;

said interconnecting means including a pushrod for imparting reciprocating movement to said sucker arm, said pushrod imparting a predetermined range of reciprocating movement whether said sucker arm is traversing said normal path or said altered path, said path altering means including retractable and extendable means for varying the length of said pushrod during operation and on demand between a normal length and an extended length.

2. The system of claim 1 wherein said interconnecting means includes a crank mounted on a pivotal sucker tube for pivotal movement thereabout, said sucker arm being mounted on said sucker tube such that pivotal movement of said crank imparts reciprocating movement to said sucker arm, said pushrod extending from said cam follower arm means to said crank for imparting pivotal movement to said crank.

3. The system of claim 2 wherein said cam follower arm means imparts reciprocating movement to said pushrod in response to driven movement by said cam means, said reciprocating movement of said pushrod imparting a predetermined range of reciprocating pivotal movement to said crank, said reciprocating pivotal movement of said crank enabling said sucker arm to feed signatures from said signature stack to said main drum.

4. The system of claim 1 wherein said cam follower arm means includes a pair of drive arms having first ends mounted on a pivotal shaft for pivotal movement thereabout, said drive arms being disposed at a fixed angle to one another with the first ends defining the apex thereof, said drive arms each having a second end such that one is operatively associated with said cam means and the other is operatively associated with said interconnecting means.

5. In a gathering machine on a binding line having a sucker arm for feeding signatures from a signature stack to a main drum, a system for selectively disabling and enabling operation of said sucker arm, said system comprising:

cam means operatively associated with said main drum for driven movement therewith;

cam follower arm means operatively associated with said cam means for driven movement thereby; and means for interconnecting said cam follower arm means to said sucker arm for imparting reciprocating movement to said sucker arm, said reciprocating movement normally traversing a path from said signature stack to said main drum and back again to feed signatures from said signature stack to said main drum for delivery to said binding line when said system enables operation of said sucker arm, said interconnecting means including means for altering said path of reciprocating movement on demand to disable said sucker arm;

said interconnecting means including a crank mounted on a pivotal sucker tube for pivotal movement thereabout and said sucker arm being mounted on said sucker tube, said sucker arm being mounted such that pivotal movement of said sucker tube imparts reciprocating movement to said sucker arm, said interconnecting means also including a pushrod extending from said cam follower arm means to said crank for imparting pivotal movement to said crank, said pushrod imparting a predetermined range of reciprocating movement whether said sucker arm is traversing said normal path or said altered path, said path altering means including means for varying the length of said pushrod on demand between a normal length and an extended length;

said path altering means causing said sucker arm to traverse an altered path wherein said sucker arm cannot feed signatures from said signature stack to said main drum until such time as said path altering means returns said sucker arm to said path of reciprocating movement from said signature stack to said main drum on demand to again enable operation of said sucker arm;

said length varying means including a cylinder and a piston comprising a portion of said pushrod, said piston being retractable and extendable on demand to thereby vary the length of said pushrod to thereby shift the location where said sucker arm is reciprocated, said pushrod being selectively extendable to a disabled position and selectively retractable to an enabled position for said sucker arm.

6. The system of claim 5 wherein said cam follower arm means imparts reciprocating movement to said pushrod in response to driven movement by said cam means, said reciprocating movement of said pushrod imparting a predetermined range of reciprocating pivotal movement to said crank, said reciprocating pivotal movement of said crank normally enabling said sucker arm to feed signatures from said signature stack to said main drum.

7. The system of claim 5 wherein said cam follower arm means includes a pair of drive arms having first ends mounted on a pivotal shaft for pivotal movement thereabout, said drive arms being disposed at a fixed angle to one another with the first ends defining the apex thereof, said drive arms each having a second end such that one is operatively associated with said cam means and the other is operatively associated with one end of said pushrod.

8. In a gathering machine on a binding line having a sucker arm for feeding signatures from a signature stack to a main drum, a system for selectively disabling and enabling operation of said sucker arm, said system comprising:

cam means operatively associated with said main drum for driven movement therewith;

cam follower arm means operatively associated with said cam means for driven movement thereby; and means for interconnecting said cam follower arm means to said sucker arm for imparting reciprocating movement to said sucker arm, said reciprocating movement normally traversing a path from said signature stack to said main drum and back again to feed signatures from said signature stack to said main drum for delivery to said binding line when said system enables operation of said sucker arm, said interconnecting means including means for altering said path of reciprocating movement on demand to disable said sucker arm;

said interconnecting means including a crank mounted on a pivotal sucker tube for pivotal movement thereabout and said sucker arm being mounted on said sucker tube, said sucker arm being mounted such that pivotal movement of said crank and said sucker tube imparts reciprocating movement to said sucker arm, said interconnecting means also including a pushrod extending from said cam follower arm means to said crank for imparting pivotal movement to said crank, said pushrod imparting a predetermined range of reciprocating movement whether said sucker arm is traversing said normal path or said altered path, said path altering means including means for varying the length of said pushrod on demand between a normal length and an extended length;

said cam follower arm means imparting linear reciprocating movement to said pushrod in response to driven movement by said cam means, said reciprocating movement of said pushrod imparting a predetermined range of reciprocating pivotal movement to said crank, said reciprocating pivotal movement of said crank normally enabling said sucker arm to feed signatures from said signature stack to said main drum;

said path altering means causing said sucker arm to traverse an altered path wherein said sucker arm cannot feed signatures from said signature stack to said main drum until such time as said path altering means returns said sucker arm to said path of reciprocating movement from said signature stack to said main drum on demand to again enable operation of said sucker arm;

said length varying means including a cylinder and a piston comprising a portion of said pushrod with said piston being retractable and extendable on demand, said piston thereby varying the length of said pushrod to thereby shift the location where said sucker arm is reciprocated, said pushrod being selectively extendable to a disabled position of operation and selectively retractable to an enabled position of operation for said sucker arm.

9. The system of claim 8 wherein said cam follower arm means includes a pair of drive arms having first ends mounted on a pivotal shaft for pivotal movement thereabout, aid drive arms being disposed at a fixed angle to one another with the first ends defining the apex thereof, said drive arms each having a second end such that one is operatively associated with said cam means and the other is operatively associated with one end of said pushrod.

* * * * *